US005459280A

United States Patent [19]

Masuda et al.

[11] Patent Number: 5,459,280

[45] Date of Patent: Oct. 17, 1995

[54] MUSICAL TONE SYNTHESIZING APPARATUS

[75] Inventors: Hideyuki Masuda; Toshifumi Kunimoto, both of Hamamatsu, Japan

[73] Assignee: Yamaha Corportion, Japan

[21] Appl. No.: 68,506

[22] Filed: May 27, 1993

[30] Foreign Application Priority Data

Jun. 3, 1992 [JP] Japan ..... 4-143010

[51] Int. Cl.[6] ..... G10H 1/12

[52] U.S. Cl. ..... 84/622; 84/661; 84/662; 84/692

[58] Field of Search ..... 84/622–625, 630, 84/659, 660, 661, 662, 673, 692–700, 707, 736, 737, DIG. 9, DIG. 10, DIG. 26

[56] References Cited

U.S. PATENT DOCUMENTS 3,558,795 1/1971 Barcus ..... 84/1.14

4,023,455 5/1977 Peterson ..... 84/1.21

4,779,465 10/1988 Stearns et al. ..... 84/398

5,131,310 7/1992 Kunimoto .

5,340,942 8/1994 Kunimoto ..... 84/661

*Primary Examiner*—Vit W. Miska

*Attorney, Agent, or Firm*—Graham & James

[57] ABSTRACT

A musical tone synthesizing apparatus for generating a musical tone which is influenced not only by blowing pressure and embouchure, etc. but also effected by the movement of a performer's tongue. The apparatus comprises an operating part WC having a mouthpiece part and a reed part; a breath measuring sensor for measuring breath passing through the mouthpiece part; a tonguing detector for measuring the relative position of a performer's tongue to the reed part; a musical tone forming circuit TC for simulating the mouthpiece, the reed, and the resonance tube of the acoustic wind instrument in response to an output signal of the breath measuring sensor so as to create a musical tone signal; and a tonguing effector for changing a simulating characteristic of the reed of the acoustic wind instrument in response to an output signal of the tonguing detector.

6 Claims, 12 Drawing Sheets

PHYSICAL MODEL CIRCUIT VOPM1
TONGUE1
REED1
HORN1
OUT1
OUT2
Zm
Zt
ROUT
RIN
P1
P2
301
305
FILTER GROUP
NL1
NL2
LPF
IIRo
refo
pr
refs
IIRs
SRs
SRL
IIR1
2gi ref1
total_len*(1-Srat)
total_len*(Srat)
go
gi
1/2
CROSS-FADE CIRCUIT
rate
trig (0 OR 1)
emb
Sr
1/Mr
Kr
μr
r

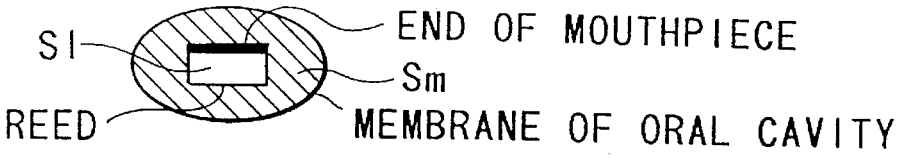
FIG.4(B-1)
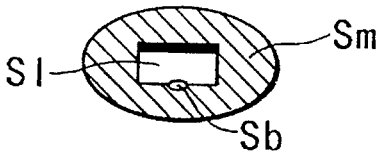
FIG.4(B-2)
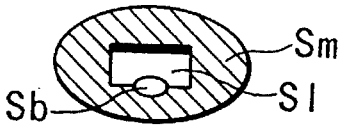
FIG.4(B-3)
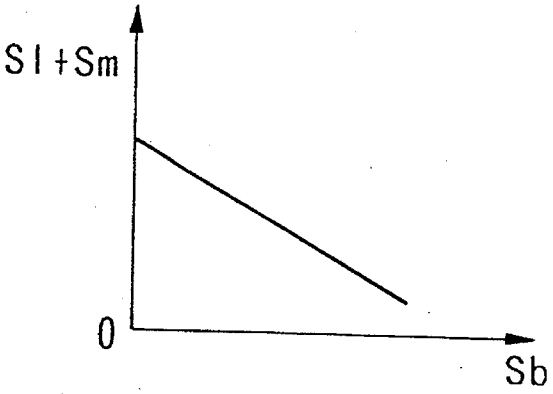
FIG.4(B-4)

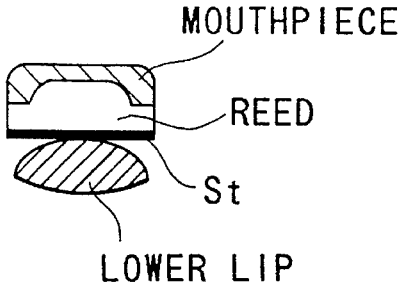
FIG.4(C)
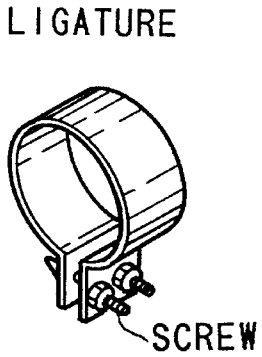
FIG.4(D)
TYPES OF TONGUING
| TYPES | MOVEMENT OF THE TONGUE |
|---|---|
| SINGLE TONGUING | ‹T› |
| HALF TONGUING | ‹K› |
| DOUBLE TONGUING | ‹TK› |
| TRIPLE TONGUING | ‹TKT› |
| | ‹TTK› |
| | ‹TKK› |
| REED DAMPING | ——— |
‹tu› → ‹T›
‹Ku› → ‹K›
FIG.4(E)

MUSICAL TONE SYNTHESIZING APPARATUS

BACKGROUND OF THE INVENTION

1. Field of the Invention

The present invention relates to a musical tone synthesizing apparatus suitable for simulating acoustic musical instruments.

2. Background Art

There are systems for synthesizing tones by simulating the sound generation mechanisms of acoustic musical instruments. For example, such an instrument is disclosed in U.S. Pat. No. 5,131,310. FIG. 11(A) shows a schematic system configuration of such a conventional musical tone synthesizing apparatus for simulating the sound generation mechanism of wind instruments. The apparatus primarily consists of two main blocks, a tone generation controller IF2 and a physical model circuit VOPM2.

The tone generation controller IF2 creates tone generation control data representing a blowing pressure P, an embouchure E, and a tone pitch data ST in accordance with the performance of a performer, and supplies the data to other elements in the apparatus. The configuration of the tone generation controller IF2 is similar to the acoustic musical instrument so that when the performer carries out a performance similar to that of the acoustic musical instrument, the above-described tone generation control data is created. Herein, the blowing pressure P is a signal designating a pressure due to the air flow, and the embouchure E is a signal designating the condition of the player's lips.

Furthermore, as shown in FIG. 11(B), the tone generation controller IF2 supplies, to the reed part REED2, an initializing signal INIT for initial reset of the system.

The physical model circuit VOPM2 consists of two sub-blocks, the reed part REED2 and a bell part HORN2, which correspond to the structure of the acoustic wind instrument. The reed part REED2 simulates the reed vibration mechanisms of tile wind instrument by utilizing the blowing pressure E and the embouchure E as excitation signals. Then, as a result of the simulation, a pressure signal P2 is supplied to the bell part HORN2. The pressure signal P2 designates the pressure per unit area of the resonance tube, the pressure being due to the performer's breath (i.e., air flow ) passing through the space between the mouthpiece and the reed of the wind instrument. In this case, a characterized response of the system is determined so as to realize a non-linear function A shown in FIG. 11(C), for example.

The pressure signal P2, created in the reed part REED2, is then transferred to the bell part HORN2 as an excitation signal. The bell part HORN2 is a circuit for creating a musical tone signal by simulating the progressing system of the air pressure wave in the resonance tube. The bell part HORN2 comprises a junction JUNC (see FIG. 11(B)) for simulating a pressure scattering system at the end of the resonance tube which is adjoined to the mouth piece.

However, according to the above-described conventional apparatuses, because the part REED2 only receives two signals, a blowing pressure P1, which is a signal determined by the blowing pressure P and the output signal of the bell part HORN2, and the embouchure E, the musical tone is not affected by actions of the performer's tongue.

Meanwhile, there is known a performance technique for wind instruments, called "tonguing", which is executed by moving the tongue in order to apply important effects to the musical tone.

SUMMARY OF THE INVENTION

Accordingly, it is an object of the present invention to provide a musical tone synthesizing apparatus for generating musical tone affected not only by the blowing pressure and the embouchure, but also by the action of the performer's tongue.

In a first aspect of the present invention, there is provided a musical tone synthesizing apparatus comprising:

an operating part having a mouthpiece part and a reed part;

a breath measuring means for measuring breath passing through the mouthpiece part;

a tonguing detection means for measuring a relative position of a performer's tongue to the reed part;

a musical tone forming circuit for simulating a mouthpiece, a reed, and a resonance tube of an acoustic wind instrument in response to an output signal of the breath measuring means so as to create a musical tone signal; and a tonguing effector for changing a simulating characteristic of the reed of the acoustic wind instrument in response to an output signal of the tonguing detection means.

Consequently, reed simulation characteristics can be changed according to movement of performer's tongue, and the musical tone is influenced by the movement.

In a second aspect of the present invention, there is provided a musical tone synthesizing apparatus comprising:

a keyboard;

a keyboard operation data generating means for generating an operation data of the keyboard;

a musical tone forming circuit for simulating a mouthpiece, a reed, and a resonance tube of an acoustic wind instrument in response to an output signal of the keyboard operation data generating means so as to create a musical tone signal; and a tonguing effector for changing a simulating characteristic of the reed of the acoustic wind instrument in response to a prespecified output signal of the keyboard operation data generating means.

Consequently, a tonguing performance can be simulated by the keyboard.

BRIEF DESCRIPTION OF THE DRAWINGS

FIGS. 4(B-1) to (B-3) are sectional views taken in line "A" in FIG. 4(A), FIG. (B-4) is a graph showing the relationship between an inner sectional areas Sm and S1, and a tongue sectional area Sb, FIG. 4(C) is a cross sectional view taken along line "A" in FIG. 4(A), FIG. 4(D) is a perspective view of a ligature, FIG. 4(E) is a table showing types of tonguing.

DESCRIPTION OF THE PREFERRED EMBODIMENT

Further objects and advantages of the present invention will be apparent from the following description, reference being made to the accompanying drawings wherein a preferred embodiment of the present invention is clearly shown.

A: Composition of embodiment

§1. System block diagram (FIG. 1)

Figure 1:
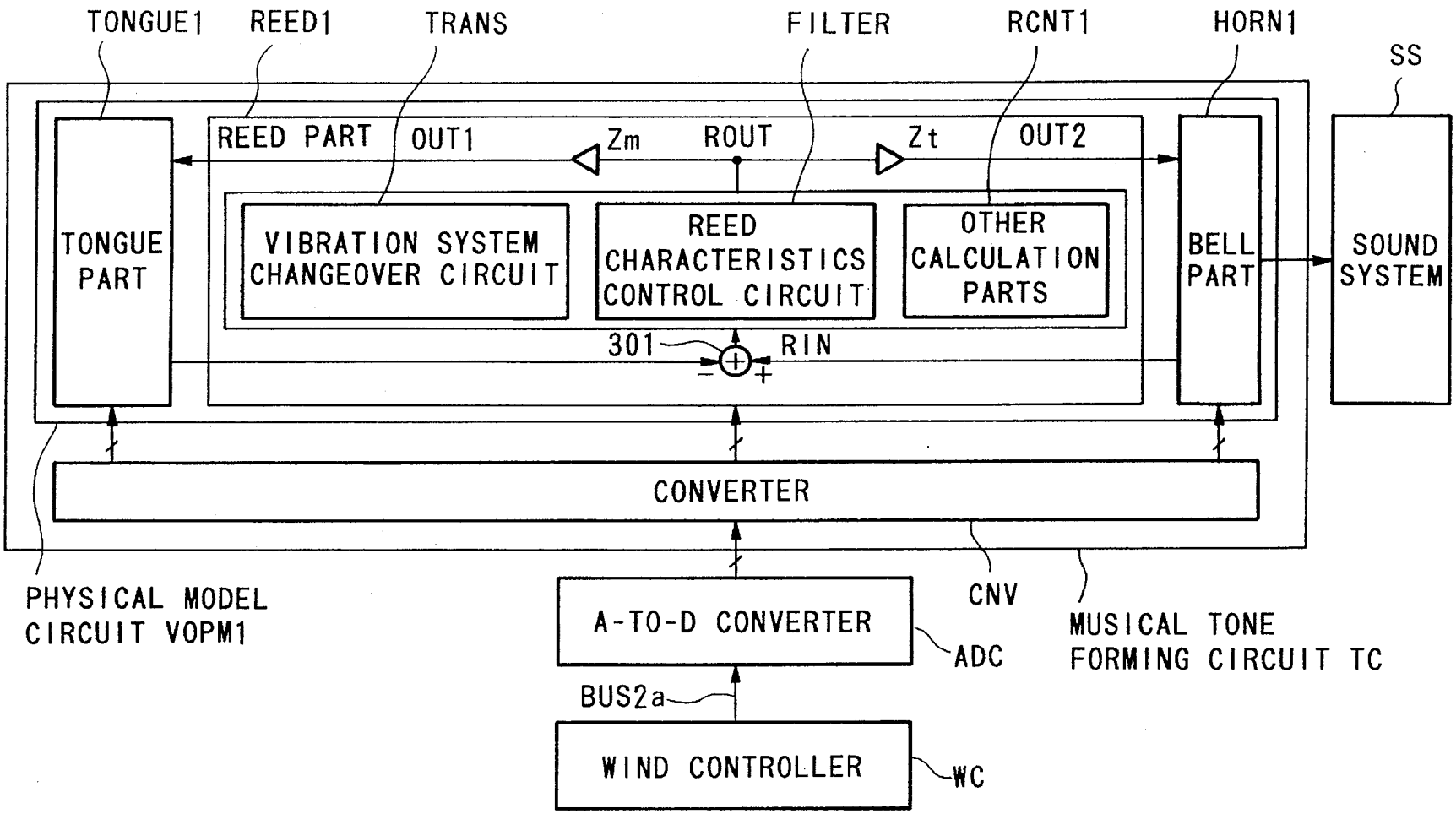
FIG. 1 is a block diagram showing a system block diagram of a preferred embodiment of the present invention.

FIG. 1 shows a block diagram of an embodiment of a musical tone synthesizing apparatus TC of the present invention which primarily consists of a wind controller WC, a converter CNV, a physical model circuit VOPM1, and a sound system. The details of the components will be described below.

§1-1. Wind controller WC and converter CNV (FIGS. 1 and 2)

Figure 2:
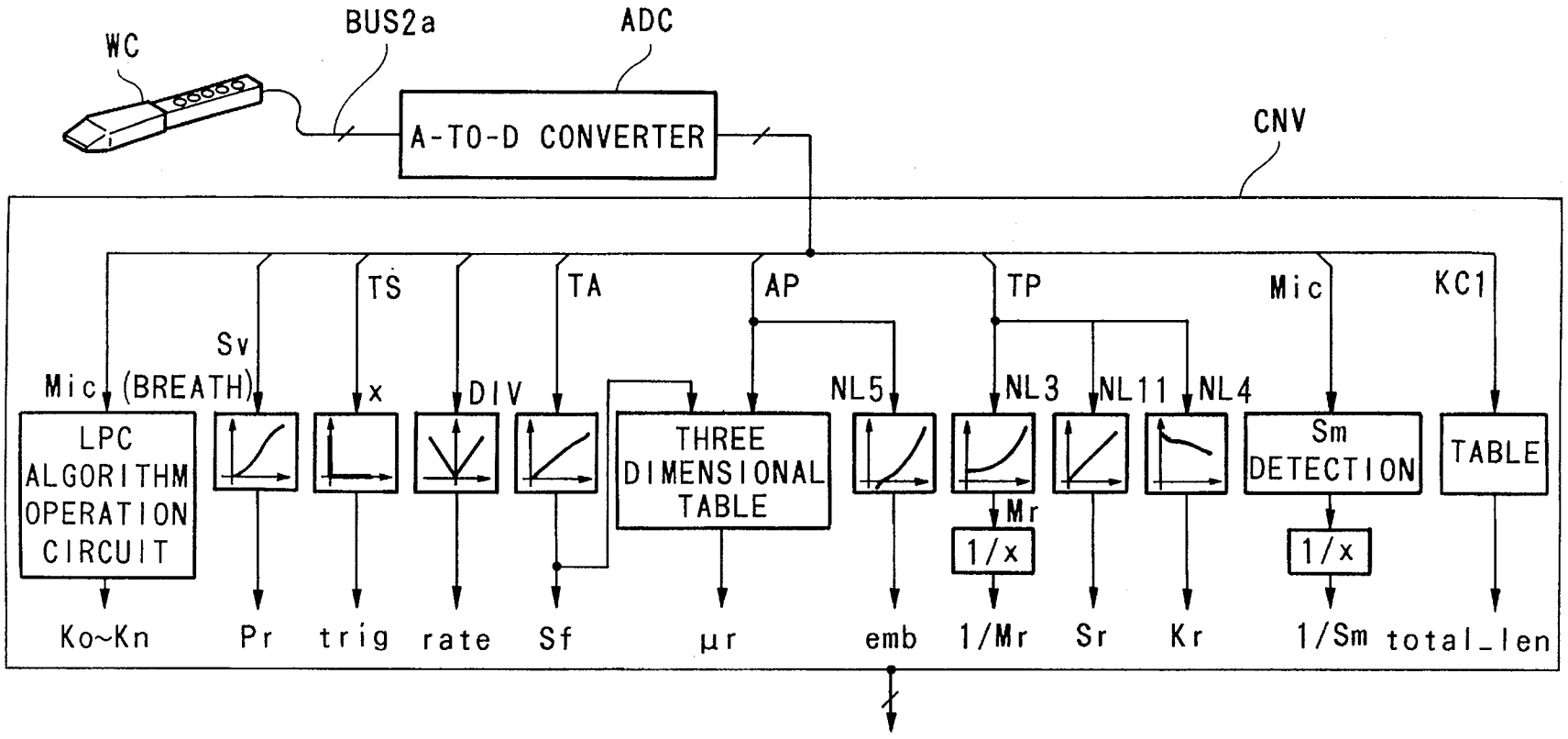
FIG. 2 is a partial block diagram showing a wind controller WC and a converter CNV in physical model circuit VOPM1.

The wind controller WC, having a shape similar to that of the wind instrument shown in FIG. 2, is provided with a mouthpiece and various keys to be operated by the performer's finger. The wind controller WC is further provided with a sensor (tonguing sensor) for measuring the distance between the tongue and the reed, and other various sensors. Various sensors are provided for measuring, for example, the catching force of the mouthpiece, position of the lips, blowing pressure, and the key-codes determined by the keys. The output signals of the sensors are supplied to converter CNV via a bus 2*a* and an A-to-D converter ADC.

The signals generated by the wind controller WC comprises a signal Mlc which is an output signal of a microphone contained in the wind controller WC, and a signal Sv which is an output signal of the blowing pressure sensor. The signal Mic is transformed, via an LPC algorithm operation circuit, to signals K0 to Kn with respect to the action of the tongue. Furthermore, an inner sectional area Sm of the cavity is determined from the signal M1c, the area Sm is transformed to its reciprocal number, and the reciprocal number is generated. Meanwhile, the signal Sv is transformed, in the non-linear function circuit, to a signal Pr representing the air pressure.

The signal TS is an output signal of the tonguing sensor, and the value of a trigger signal trig, "1" and "0", is determined according to the level of the signal trig. Further, the signal DIV is a differential value (absolute value) of the signal TS. The signal DIV is interpolated by a prespecified table, so that a signal rate showing the tonguing speed is generated.

The signal TA is an output signal of the sensor measuring the softness of the player's lips. The signal TA is transformed, by means of a prespecified table, to a signal Sf which represents the square measure of the area of the tongue touching the reed. The wider the area of the tongue touching the reed, namely, the larger the signal Sf, the greater the degree of absorption of the reed vibrations by the tongue and, thus, the greater the degree to which the volume of the musical tone is decreased. Conversely, the smaller the signal Sf, the smaller the degree of absorption of the reed vibrations by the tongue and, thus, the smaller the degree to which the volume of the musical tone is decreased.

The signal AP, which corresponds to the aperture of the reed, varies according to the pitch variation of the musical tone. A signal μr representing a damping factor of the reed is created by means of a prespecified three dimensional table in which the signals AP and Sf are utilized as variables. Furthermore, the musical tone signal AP is transformed to the embouchure E by means of another prespecified table.

The signal TP, representing tonguing position, corresponds to the distance between the end of the reed and the part of the reed touching the tongue. The signal TP is transformed, by means of prespecified tables, to four signals: a reed mass Mr representing the mass of the reed, the reciprocal number of the reed mass Mr, tile effective reed area Sr, and the reed spring index Kr. The characteristics of the signals are shown in corresponding blocks in FIG. 2.

The signal KC1, representing the pitch name of the musical tone, is transformed, by means of another table, to a signal total len representing a pitch frequency of the musical tone. The signal total len is supplied to the bell part HORN1 of the physical model circuit VOPM1 (see FIG. 1)

§1-2. Tongue simulator TONGUE1 in physical model circuit VOPM1 (FIGS. 1 & 3)

Next, the details of the tongue simulator TONGUE1 in the physical model circuit VOPM1 will be described, with reference being made to FIGS. 1 and 3.

The tongue simulator TONGUE1 is a circuit utilizing parameters with respect to the shape of the oral cavity, so that the tongue simulator TONGUE1 simulates the action of the tongue (see FIG. 1). The tongue simulator TONGUE1 receives signals K0 to Kn from the converter CNV, and receives parameters with respect to the shape of the oral cavity from the reed part REED1. The reed part REED1 forms a vibration system corresponding to the input signals supplied thereto so as to generate the signal P corresponding to the pressure.

Figure 3:
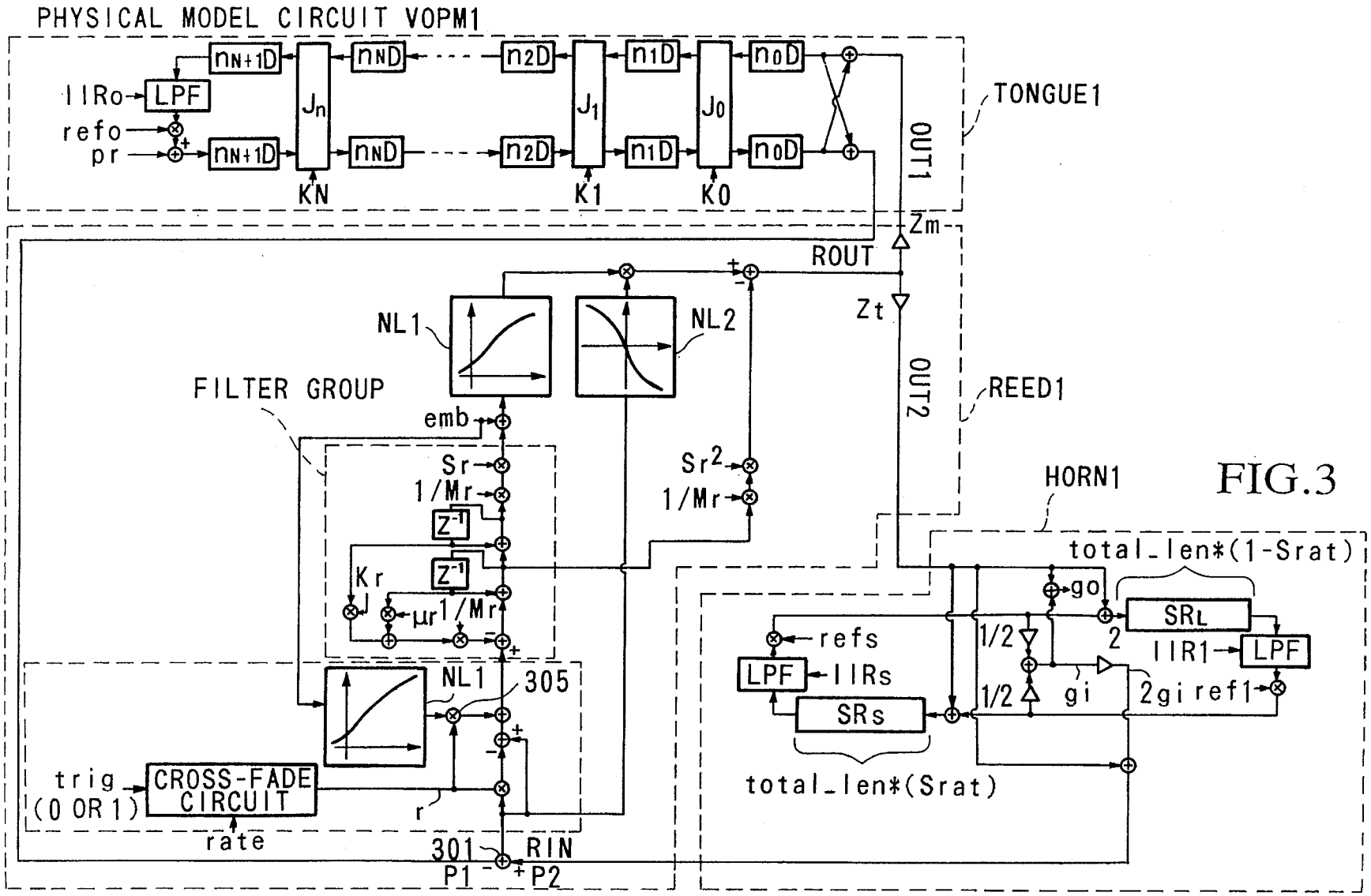
FIG. 3 is a circuit diagram of a physical model circuit VOPM1.

The details of the tongue simulator TONGUE1 are shown in FIG. 3. In FIG.3, the tongue simulator TONGUE1 primarily consists of adders, multipliers, and delay circuits. The junctions J0 to Jn are provided for simulating the scattering condition of the air pressure wave with reference being made to the signals K0 to Kn which correspond to the shape of the oral cavity. The filter characteristics of the low pass filter LPF are set corresponding to the shape of the end of the oral cavity. Furthermore, the circuit receives the blowing pressure Pr and a reflection coefficient refo representing the reflection coefficient at the end of the oral cavity. §1-3. Reed part REED1 in physical model circuit VOPM1

§1-3-1. Overall configuration of reed part REEDi(FIGS. 1 and 3)

Next, the details of the reed part REED1 will be described, with reference being made to FIGS. 1 and 3. The reed part REED1 simulates the successive change of dynamic characteristics of the reed, detects the presence of tonguing, and changes over the physical systems according to the result of the detection. As shown In FIG. 1, the reed part REED1 primarily consists of a signal input part having an adder 301, a reed calculation part RCNT1, and a signal output part utilizing coefficients Zm and Zt.

The signal input part receives signals P1 and P2 from the tongue simulator TONGUE1 and the bell part HORN1, respectively. In this case, the effect on the air pressure wave by the dynamic characteristics of the bell part HORN1, and the effect on the air pressure wave by the dynamic characteristics of the tongue simulator TONGUE1, have exactly opposite vector direction. Therefore, the adder 301 subtracts the signal P1 from P2, and generates the subtraction results as a signal RIN.

The reed calculation part RCNT1 executes a signal processing in response to the signal RIN. A signal ROUT obtained as a result of the processing is multiplied by coefficients Zm and Zt, respectively, and the multiplication results are obtained as the signals OUT1 and OUT2. The signals OUT1 and 0UT2 are supplied to the tongue simulator TONGUE1 and the bell part HORN1, respectively.

Next, the details of the reed calculation part RCNT1 will be described, with reference being made to FIGS. 1 and 3 to 7.

§1-3-2. Outline of the reed calculation part RCNTi(FIG. 1)

As shown in FIG. 1, the reed calculation part RCNT1 consists of a vibration system changeover circuit TRANS, reed characteristics control circuit FILTER and other calculation parts. The vibration system changeover circuit TRANS changes over the vibration system when the trigger signal trig becomes "1". The reed characteristics control circuit FILTER executes a process for obtaining dynamic characteristics of the reed in response to the signals supplied thereto from the converter CNV of the reed and from the circuit simulating the system corresponding to the vibration system changeover circuit TRANS.

§1-3-3. Vibration system changeover circuit TRANS (FIG. 3)

The vibration system changeover circuit TRANS has the functions as follows. That is, the circuit TRANS determines whether or not the waveform is to be made discontinuous, in response to a Judgement as to whether or not the distance between the reed and the tongue is "0". Furthermore, the circuit TRANS determines the degree of discontinuity. In other words, the circuit TRANS operates so as to vary the degree of discontinuity of the wave, or to make the wave completely continuous.

The details of the vibration system changeover circuit TRANS will be described with reference being made to FIG. 3.

First, the vibration system changeover circuit TRANS shown in FIG. 3 primarily consists of a non-linear function NL1, interpolation circuit LPF, a plurality of adders and a plurality of multipliers 302 to 305.

Figure 9A:
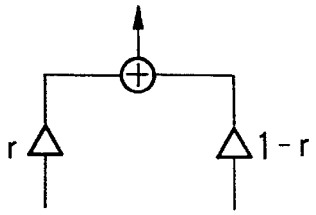
Figure 9B:
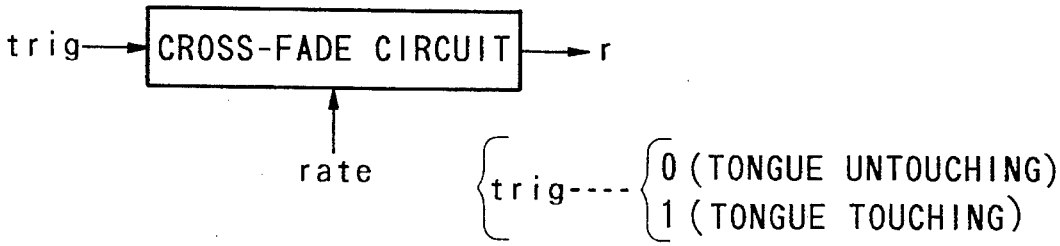

According to such a composition, when it is detected that the tongue is touching the reed, the trigger signal trig becomes "1", and signal r changes from "0" in response to the signal rate. Therefore, the degree of displacement, caused by the tongue touching tile reed, is controlled. Furthermore, the vibration system changeover circuit TRANS contains a cross-fade circuit comprising multipliers and an adder as shown in FIG. 9(A). Consequently, the circuit TRANS can continuously simulate the change in the condition of the vibration system, these condition changes being caused by the tongue touching the reed and by changes in reed displacement due to the embouchure Emb.

In other words, the cross-fade circuit mixes the signal affected by tonguing, with another signal independent of the tonguing and controls the mixing ratio thereof.

The functions of the vibration system changeover circuit TRANS are as following.

For example, when the reed and the tongue are apart, the signal r is "0". Therefore, the signal, obtained by referring to the non-linear function NL1, is made void by the multiplier 305. Meanwhile, even if the signal r is "0", because the non-linear function NL1 is always referred to, just when the trigger signal trig becomes "1", the characteristics of a forcible reed displacement (i.e., a reed displacement caused by the tongue touching the reed) at that time are controlled.

§1-3-4. Reed characteristics control circuit FILTER (FIG. 3)

The details of the reed characteristics control circuit FILTER, contained in the reed calculation part RCNT1, will be described with reference being made to FIG. 3. In the drawing, the reed calculation part RCNT1, consisting of various types of filters, applies dynamic characteristics to the reed in response to the signals received from the vibration system changeover circuit TRANS. Therefore, in both the case where the distance between the reed and the tongue is "0", namely the tongue is touching the reed, and the case where the reed and the tongue are apart, reed characteristics are applied in response to the conditions of each of these systems, respectively.

The applying of the reed characteristics is executed by utilizing the effective reed area St, the reed mass Mr, the damping factor μr and the reed spring index Kr, as shown in FIG. 3. As described above, these parameters are supplied by the converter CNV. The reed mass Mr, the effective reed area Sr, the reed spring index Kr, and the damping factor μr, which are fed to the reed characteristics control circuit FILTER in FIG. 3, are obtained by the non-linear functions NL3, NL11, NL4, and NL5 shown in FIG. 2, respectively. These non-linear functions can be determined according to various measured data and logical values so as to obtain the effects of acoustic musical instruments, but also can be determined arbitrarily so as to obtain new effects.

Next, description will be made of the non-linear functions NL3, NL4, and NLS.

First, the non-linear function NL3, which transforms the signal TP to the reed mass Mr, has a non-linear characteristic such that as the signal TP nears the value corresponding to the reed end, the reed mass Mr decreases. The non-linear function NL4, which transforms the signal TP to the reed spring index Kr, has a non-linear characteristic such that as the signal TP nears the value corresponding to the reed end, the reed spring index Kr increases. The non-linear function NL5 generates the damping factor fir according to the signal AP and the signal TA. The function NL5 has a non-linearity such that as the signal TA increases, in other words, as a square measure Sb of the reed touching the tongue increases, the damping factor μr increases, and as the signal AP increases,-the signal μr decreases. This is because, as the square measure Sb of the reed touching the tongue increases, the absorption of the kinetic energy of the pressure wave in the reed increases, and as the signal AP decreases, so the absorption of the kinetic energy of the pressure wave in the reed increases.

§1-4. Bell part ItORN1 in the physical model circuit VOPM1 (FIGS. 1 and 3)

Next, a description will be made of the bell part HORN1 in the physical model circuit VOPM1, with reference being made to FIGS. 1 and 3. The bell part HORN1 is provided for simulating the resonance tube so as to create musical tone signal. As shown in FIG. 1, the signal total len and the signal OUT2 supplied by the reed part REED1 are utilized as input signals to the bell part HORN1. As shown in FIG. 3, the bell part HORN1 comprises delay circuits SR1 and SRs each having a delay time corresponding to the signal total len. As described above, because the signal total len corresponds to the key-code KC1, the delay times of the delay circuits is determined according to the key-code KC. Consequently, the pitch of the musical tone created in the physical model circuit VOPM1 is determined corresponding to the key-code KC.

Furthermore, with respect to the signals propagated through the delay circuits SR1 and SRs, the bell part HORN1 eliminates unnecessary signal components for musical tone wave creation and applies various characteristics by means of low pass filter LPF.

§2. Algorithm model (FIG. 4)

According to the embodiment, the output signals of the wind controller WC are transformed to adequate data by means of the converter CNV, and the data obtained is utilized for simulating the system which applies the tonguing effect to the musical tone. Furthermore, during such a process, various non-linear functions and formulae representing theoretical grounds, etc. are utilized. Next, the relationship between the functions and formulae, etc. with respect to the simulation will be described, with reference being made to FIGS. 4(A) to (E).

Figure 4A:
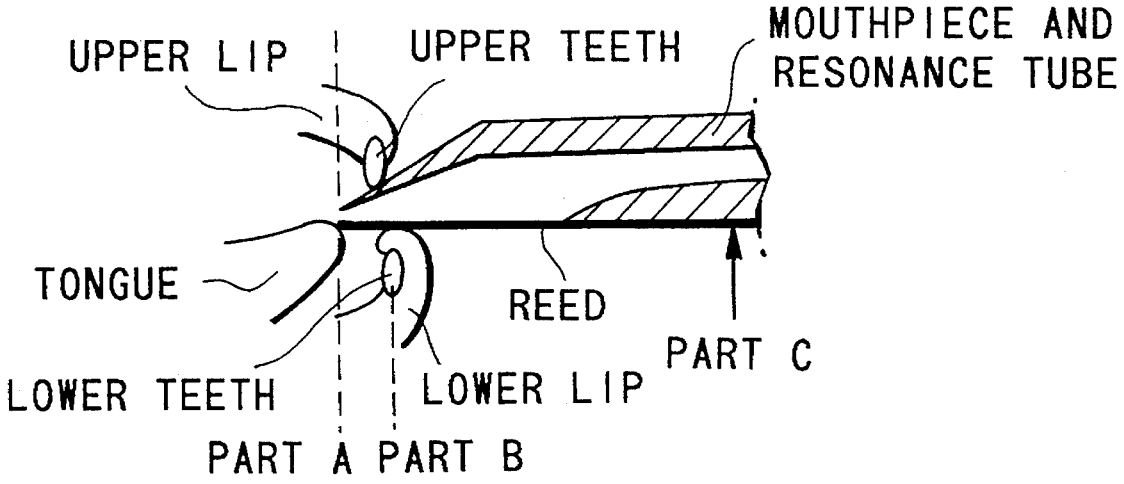
FIG. 4(A) shows a relationship between the mouthpice of an acoustic wind instrument and an oral cavity.

FIG. 4(A) shows the relationship between the mouthpiece of an acoustic wind instrument and an oral cavity. The drawing shows the schematic section of the portion where the performer touches the mouthpiece.

In the drawing, the part A designates a reed end where the tongue touches the reed when tonguing is performed. The part B designates a point on the performer's lip where the lip touches the reed thereby applying an upward pressure on the reed. The mouthpiece is supported by the upper and lower jaws of the performer, and tile tongue moves freely in the oral cavity. Such a condition is simulated in the tongue simulator TONGUE1 (see FIG. 1 and 3). The air (i.e., performer's breath) passing through the resonance tube is represented by a vector quantity having a modulus and a direction.

Further, the reed fitted on the lower face of the mouthpiece is further fitted on the resonance tube at part C by means of a "ligature" shown in FIG. 4(*d*). According to such a composition, when air passes through the tube, the reed vibrates. Therefore, it is assumed that a periodic motion of a mass point having a predetermined mass exists at an arbitrary point in the reed. Consequently, in the present embodiment, the reed vibration is modeled such that a point (i.e., reed end or the point where the tongue touching the reed) which is deemed to be a mass point moves periodically.

More specifically, the reed is modeled as a mass point having the mass Mr and vibrating with a spring index Kr. Further, the embouchure Emb, which is applied as the forcible displacement of the reed, is a parameter to which the periodic motion of the mass point is participated.

The reed spring index Kr is created from the signal TP generated by the wind controller WC and is for realizing the changes in moment and the changes in condition wherein, due to the tongue touching the reed, the kinetic energy of the mass point is absorbed.

Next, the relationship between the mouthpiece in FIG. 4 (A) and the oral cavity will be described with reference being made to the sectional views in FIGS. 4(B-1) to (B-4) and (C).

FIG. 4(B-1), (B-2), and (B-3) respectively show the cross section of FIG. 4(A). These drawings show a modelization of how the shapes of the inner sectional area Sm of the oral cavity, the inner sectional area S1 of the resonance tube, and the area Sb change corresponding to the relative position of the reed end and the tongue.

FIG. 4(B-4) shows the relationship between the inner sectional areas Sm and S1, and the tongue sectional area Sb. The shape of the oral cavity and the motion of the tongue are independent. That is, the value "Sm+Si" maintain a constant relationship when the tongue is not in contact with the reed.

According to FIGS. 4(B-1) to (B-3), as the tongue which is not in contact with the reed gradually nears the reed, the condition gradually changes from that shown in FIG. 4(B-1) to that shown in FIG. 4(B-2). Furthermore, as the tongue, slightly touching the reed at an initial state, gradually presses against the reed, the condition gradually changes from that shown in FIG. 4(B-2) to that shown in FIG. 4(B-3).

When the condition is set between that in FIG. 4(B-1) and that just before FIG. 4(B-2), the tongue is not in contact with the reed. Therefore, the value "Sm+Si" maintains a constant relationship. In this case, the tube inner sectional area S1 has a maximum value. Then, the condition changes to that shown in FIG. 4(B-2), and as the tongue gradually presses against the reed, the value "Sm+Si" decreases by the square measure Sb of the area of the contact between the reed and the tongue. Then, the condition finally becomes that shown in FIG. 4(B-3).

Although Sm and S1 are effected by the area Sb of contact between the reed and the tongue, in the hypothetical model in this embodiment, it is given that the oral cavity inner sectional area Sm and the tube inner sectional area S1 have the following relationship.

That is, as Sm decreases, S1 increases, and as Sm increases, S1 decreases.

FIG. 4(C) shows a vertical cross sectional view of part B for modeling the relationship between the shape of the oral cavity at the medium part of the reed, the lower lip, and the resonance tube. The tube inner sectional area St varies according to the reed displacement, to the pressure applied on the reed by the lower lip, and to the blowing pressure Pr, etc. Furthermore, the variation of the area St affects the change of the vertical cross section of the part A described above.

As described above, when a prespecified model is assumed, the part corresponding to the control signals is determined, and when the signal processing corresponding to the assumed model is executed by the converter CNV, a signal in accordance with changes in the performance conditions is generated in real time by the converter CNV.

B: Operation of embodiment

Next, a description will be made of the operation for applying the tonguing effect.

It is assumed that the trigger signal trig is "0" in the initial state wherein the tongue is apart from the reed.

When the performer executes tonguing (i.e., a single tonguing or a half tonguing), the tongue touches the reed and the tonguing trigger signal trig becomes "1". As a result, the signal r generated by the vibration system changeover circuit TRANS (see FIG. 3) is determined according to the signal rate. In other words, the signal r is determined according to the tonguing speed. Then, the process of crossfading is started so that the characterization of the sound is executed by means of the non-linear function NL1 shown in FIG. 3.

Furthermore, because the reed characteristics control circuit FILTER simulates reed characteristics in accordance with the received signals Sr, 1/Mr, Kr, and μr, the signals 0UT1 and 0UT2, which are generated by the reed part REED1, become the signals corresponding to the tonguing performance to the simulated reed.

This invention may be practiced or embodied in still other ways without departing from the spirit or essential character thereof as shown in the following modifications.

Therefore, the preferred embodiment described herein is illustrative and not restrictive, the scope of the invention being indicated by the appended claims, and all variations which fall within the meaning of the claims are intended to be embraced therein.

C: Modifications of the embodiment

§1. Modification of vibration system changeover circuit TRANS

§1-1. Modification with forcible displacement and variable discontinuity of the waveform (FIG. 5(A))

Figure 5A:
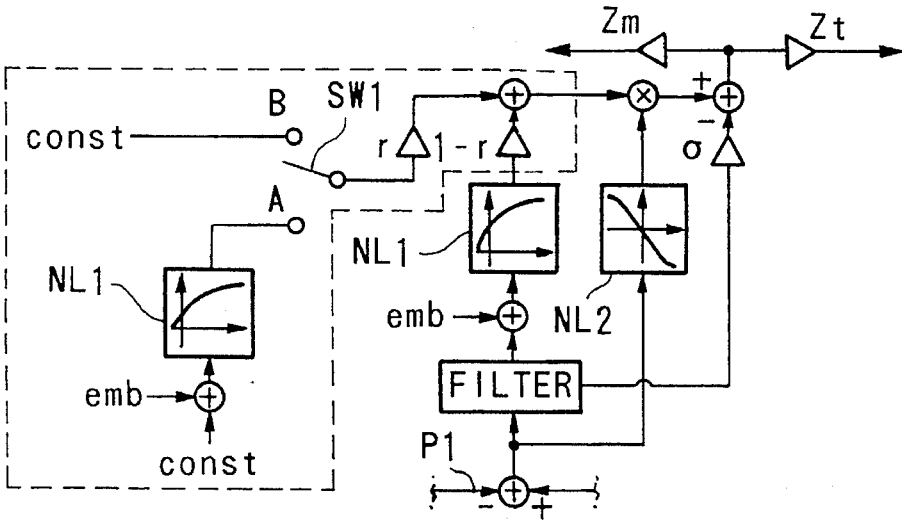
FIGS. 5(A) to 5(C) are modified circuit diagrams of the vibration system changeover circuit TRANS.

FIG. 5(A) shows modified one of the vibration system changeover circuit TRANS, the modified circuit corresponding to the condition wherein the performer pushes the reed up at its lower end face using tile tongue. The modified circuit determines a forcible displacement of the reed according to the measured area of the reed touching the tongue, and also determines the value of discontinuity of the waveform. The forcible displacement of tile reed can also be obtained by an arbitrary constant const.

According to this circuit, if it is desirable that the forcible displacement is determined according to the embouchure Emb, a switch SW is turned to a terminal A so as to transform the addition results of the embouchure Emb and the constant const, to a signal representing the tongue position by means of the non-linear function NL1.

Meanwhile, if it is desirable that the forcible displacement is determined without regard to the embouchure Emb and if the distance between the tongue and the reed is "0", the switch SW is turned to a terminal B so as to simulate the condition wherein the reed is fixed at a predetermined position by the tongue.

Figure 5B:
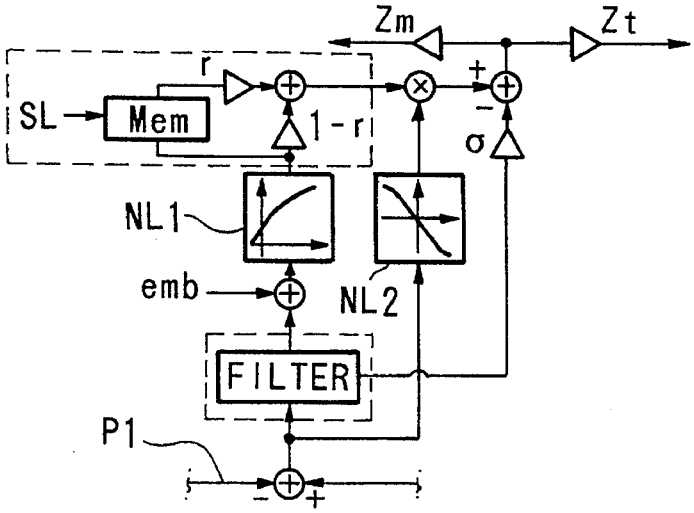

§1-2. Modification with displacement latching and slightly variable discontinuity of the waveform FIG. 5(B) shows another modified circuit of the vibration system changeover circuit TRANS, the modified circuit corresponding to the condition wherein the performer's tongue, touching the reed end, is in the direction in which the reed will not be displaced. The modified circuit latches the displacement continuously, according to the measured area of the reed touching the tongue.

For the situation wherein the performer's tongue, which touches only the reed end, is in the direction in which the reed will not be displaced, examples may be enumerated wherein the tongue instantaneously touches and parts from the tongue, and that the tonguing is executed only for cutting the sound in a moment. Such examples are included in the abovedescribed "single tonguing".

In FIG. 5(B), a memory circuit Mem, which latches the output signal of the non-linear function NL1, is provided for realizing tonguing with a smooth sound continuation.

More specifically, just when the distance between the tongue and the reed becomes "0", a load signal SL is turned to an enable condition, and the output signal of the non-linear function NL1 at that moment is stored in the memory. Consequently, as long as tile distance between the tongue and the reed is "0", the memory holds its output signal level, and cross-fading is executed by the signal r which is responsive to the trigger signal trig and the signal rate. In contrast, when the tongue parts from the reed, the load signal SL is revoked, and the signal r is turned to "0". Consequently, tile circuit condition returns to that when the tongue is apart from the reed.

§1-3. Modification for realizing a zero forcible displacement (FIG. 5(C))

Figure 5C:
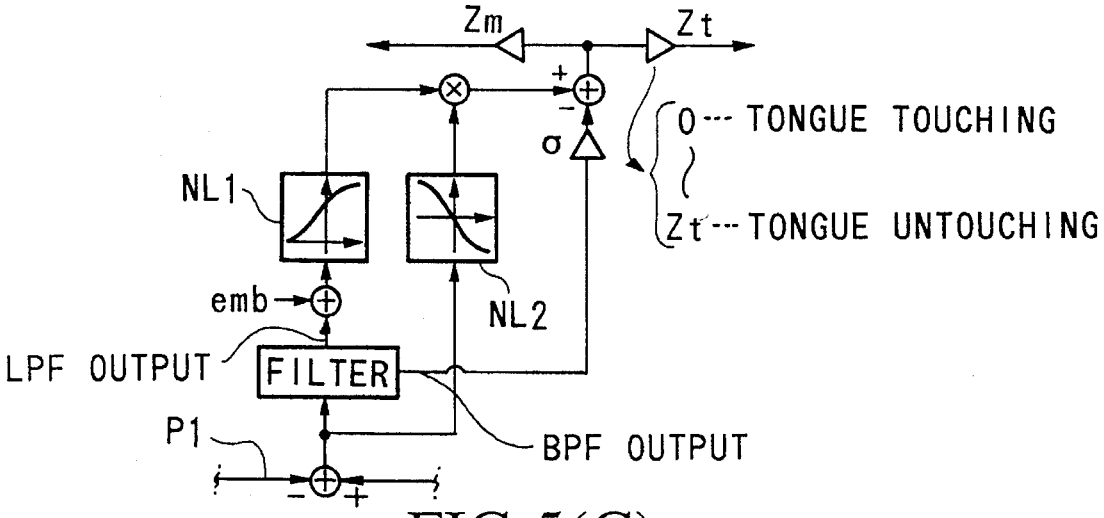
Figure 8:
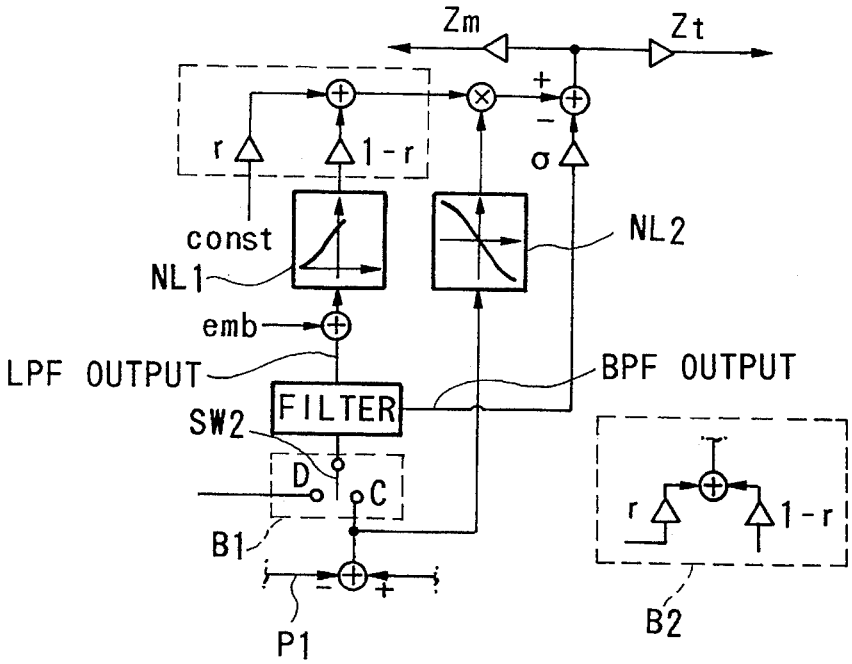

The modified reed part REED1 in FIG. 5(C) does not comprise the vibration system changeover circuit TRANS. Therefore, this circuit is a simplified version of that in FIG. 5(A) and utilizes the signal Zt on the assumption that the signal Zt has a function similar to that of the vibration system changeover circuit TRANS. More specifically, when the tongue touches tile reed, the signal Zt is set at "0" so that zero forcible displacement is realized. §1-4. Other Modifications FIG. 8 shows another modification of the reed part REED1, for replacing, by means of a switch B1, the signal supplied to the reed characteristics control circuit FILTER, with a more appropriate one, just when the tongue touches the reed. The switch B1 may be replaced with a cross-fade circuit B2. Therefore, the condition of the vibration system is changed at a moment, and the reed characteristics thereafter can be appropriately controlled.

The switch B1 is preferable in the case where it is desirable to realize an arbitrary forcible displacement in an instant, and the discontinuity status of the wave thereof should be stabilized at a constant value. Meanwhile, the cross-fade circuit B2 is preferable for smoothing those operations.

Figure 6A:
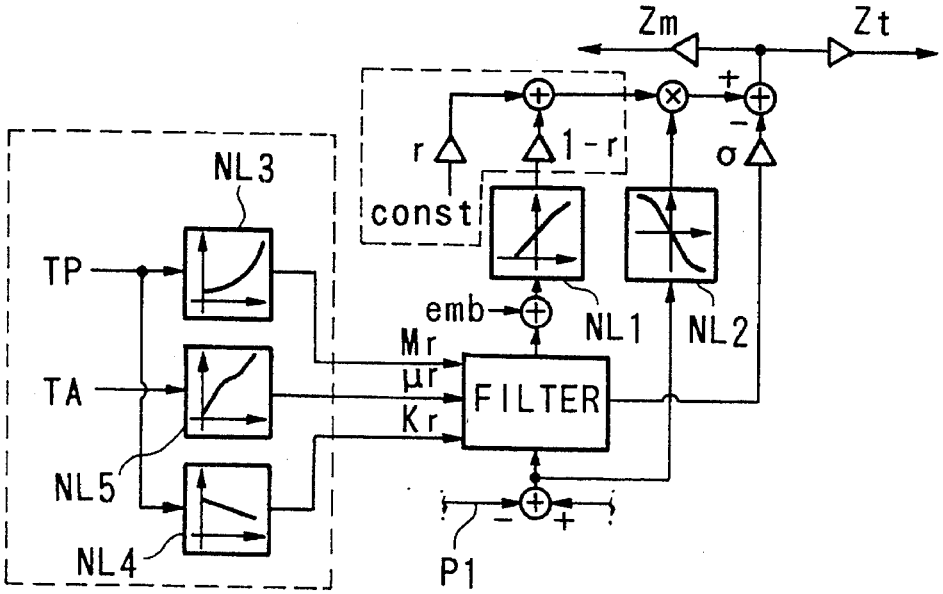
FIGS. 6(A), 6(B), 7(A), 7(B) and 8 are modified reed characteristics control circuits, FIGS. (A) and 9(B) are circuit diagrams of a cross-fading circuit.
Figure 6B:
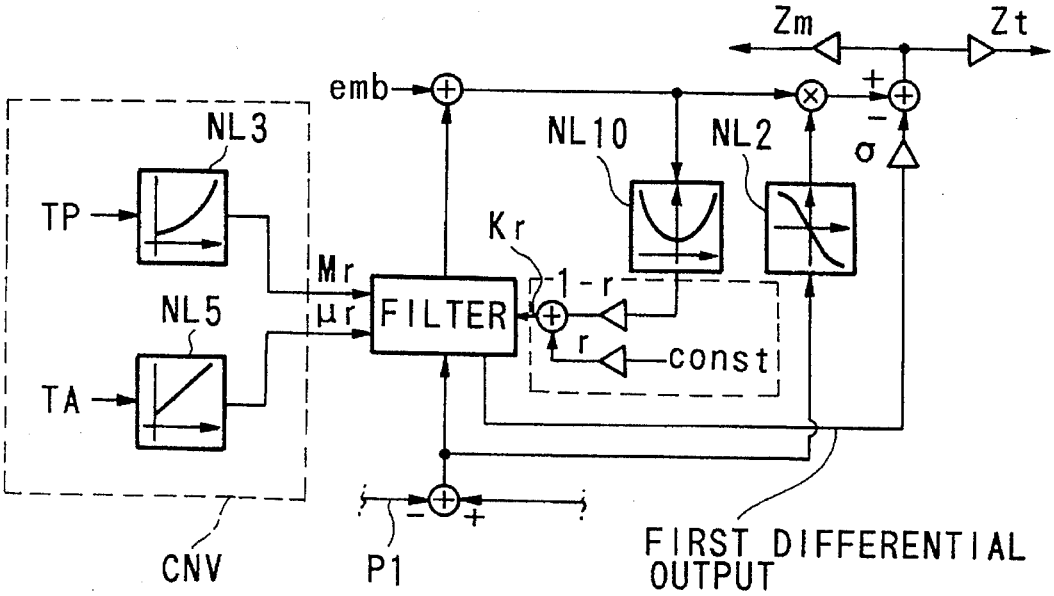
Figure 7A:
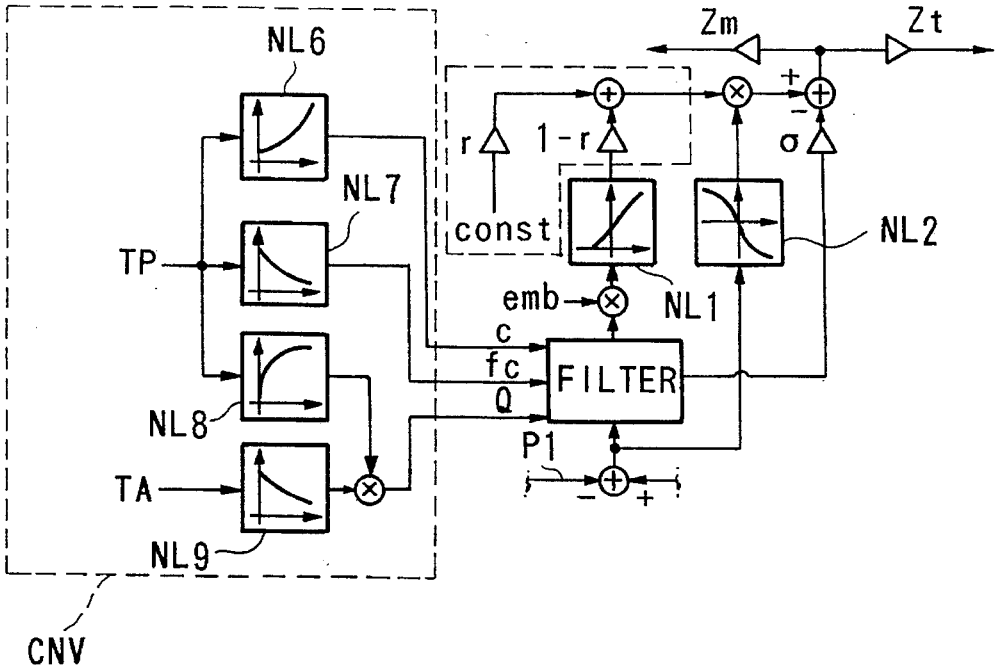
Figure 7B:
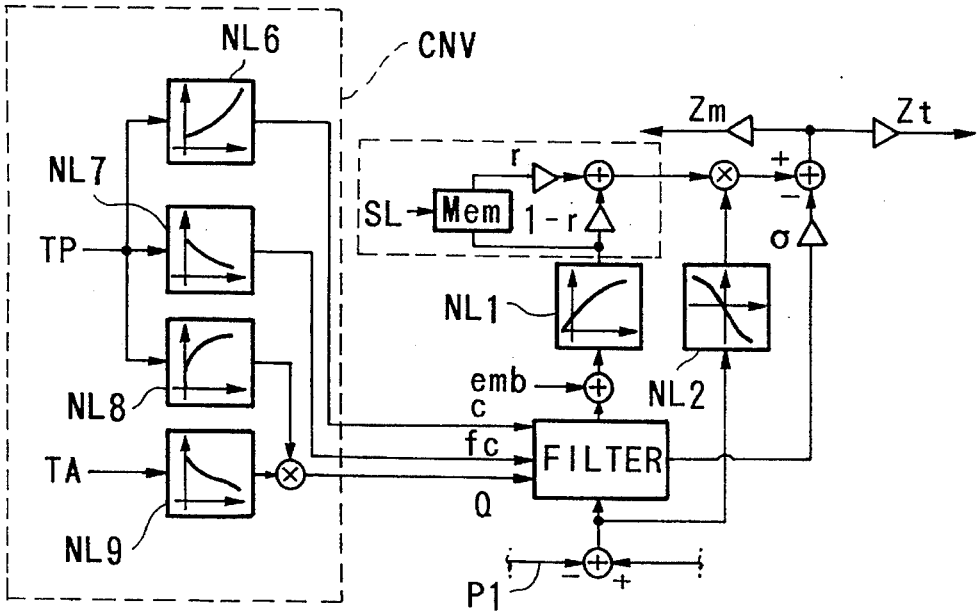

§2. Modifications for reed characteristics control circuit FILTER (FIGS. 6 and 7)

§2-1. Modifications of the circuit FILTER utilizing reed mass Mr, reed spring index Kr, and damping factor μr for changing the characteristic FIG. 6(A) shows a modified reed characteristics control circuit model on the basis of a phenomenon that the movement of the tongue should be damped down when the tongue is touching the reed.

More specifically, the model comprises a non-linear function NL4 for generating the reed spring index Kr, in place of the tonguing position TP supplied by the converter CNV.

§2-2. Modification for controlling the reed characteristics control circuit FILTER by cut-off frequency fc, signal selection ratio Q and gain c (FIGS. 7(A) and (B))

The reed characteristics control circuit FILTER may be controlled by other parameters which are expressed by the reed mass Mr, the reed spring index Kr and the damping factor μr.

In this case, the cut-off frequency fc, the signal selection ratio Q and gain c are utilized for control. However, the composition of the reed characteristics control circuit FILTER may be modified from that shown in FIG. 3.

Figure 10:
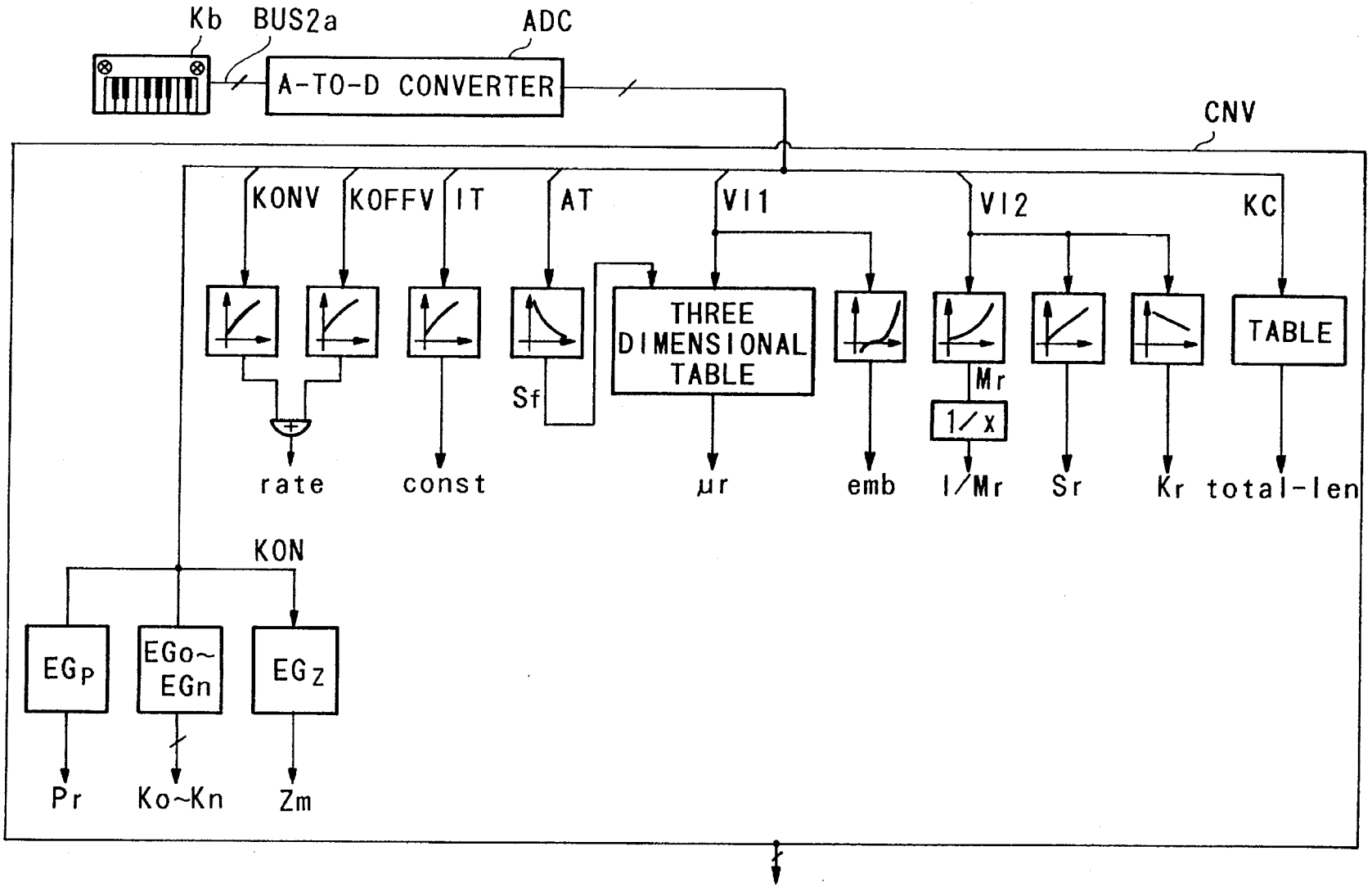
FIG. 10 is a partial block diagram of a modified embodiment utilizing a keyboard musical instrument KB.
Figure 11A:
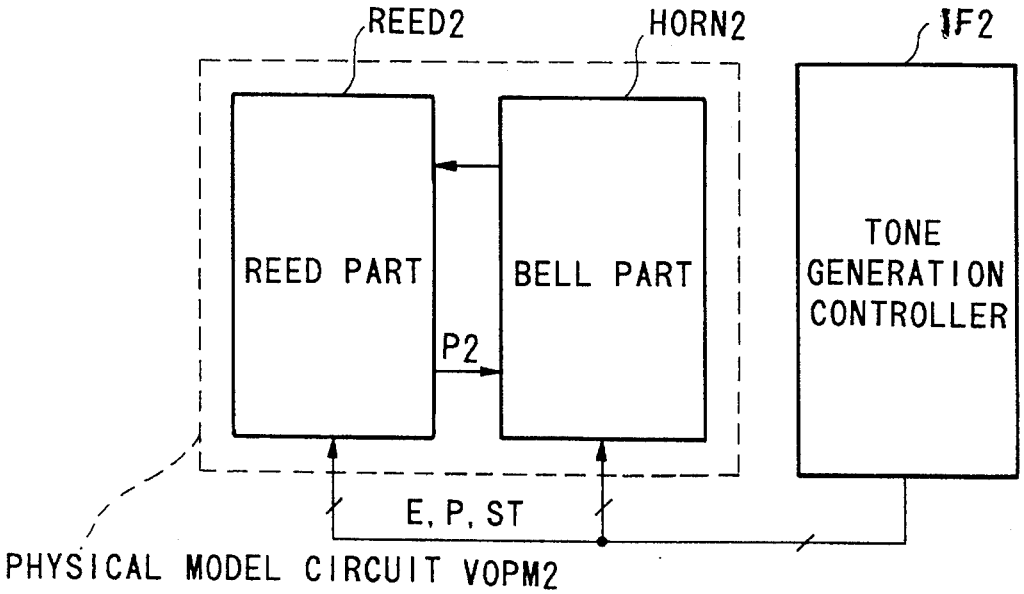
FIG.11(A) (PRIOR ART)
FIG. 11(A) is a schematic block diagrams of a conventional musical tone synthesizing apparatus.
Figure 11B:
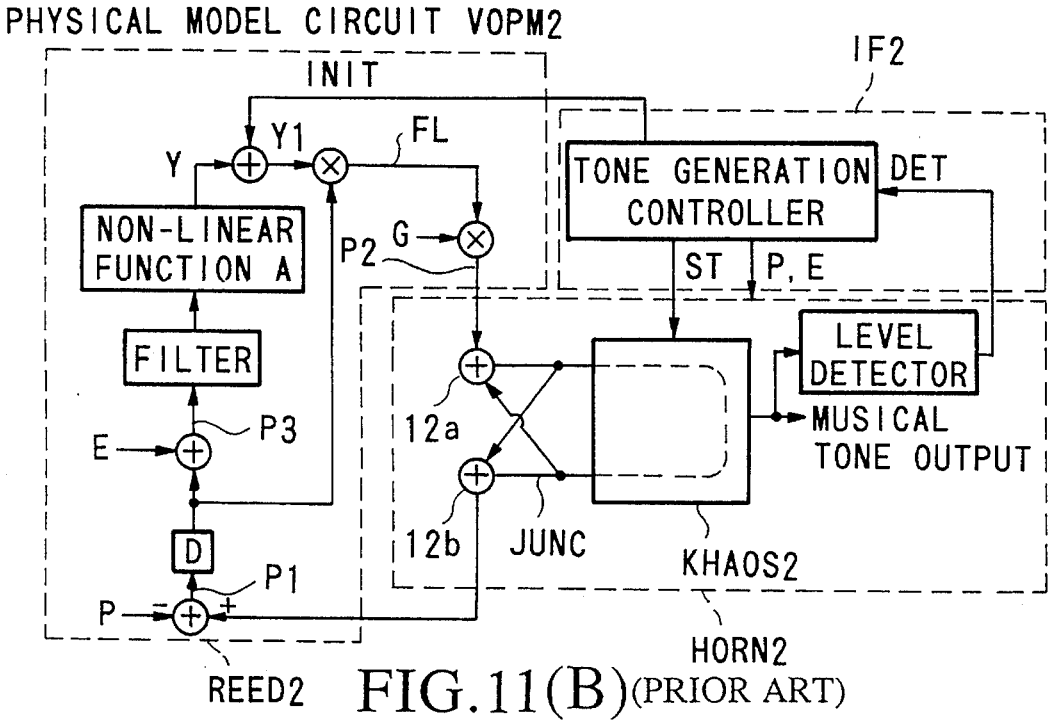
FIG.11(B) (PRIOR ART)
FIG. 11(B) is a schematic block diagram of a conventional physical model circuit.
Figure 11C:
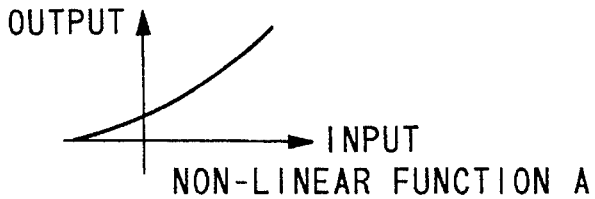
FIG.11(C) (PRIOR ART)
FIG. 11(C) is a graph showing a non-linear function A.

§3. Modification utilizing a keyboard musical instrument KB in place of the wind controller WC (FIG. 10)

A modification utilizing a keyboard musical instrument KB for supplying the performance data of the performer to the physical model circuit VOPM1 will be described with reference being made to FIG. 10.

The signal KON generated by the keyboard instrument expresses a depression of a key. The signal KON is utilized as a trigger signal in envelope generators EGp, EG0 to EGn, and EGz. The output signal of the envelope generator EGp is utilized as the signal Pr, and those of the envelope generators EGO to EGn, and EGz are utilized as the signals K0 to Kn, and $Z_m$, respectively. The signals K0 to Kn are determined on the basis of the assumption of shape change of the oral cavity by tile tongue in tonguing, so that the envelopes EGO to EGn are determined.

The signal KONV, representing a key depression speed, is transformed to a digital signal by a prespecified function. Furthermore, the signal KOFFV, representing the key releasing speed, is also transformed to another digital signal by another prespecified function. Then, an interpolation speed rate is obtained by summing the digital signals. The signal IT, corresponding to the initial touch, is transformed to a constant value const by a prespecified function. Furthermore, by means of a prespecified function, the signal AT corresponding to the after touch is transformed to a signal Sf corresponding to the touching area.

The signals VI1 and VI2 express pitch control data (i.e., pitch bending data) having the values corresponding to an operation amount of the pitch benders. The signal VI1 is utilized as a signal corresponding to the aperture, and utilized, together with the signal Sf, as an input signal to the three dimensional table. As In the embodiment described above, the output signal of the three dimensional table is μr.

Meanwhile, the pitch control data VI2, utilized as the signal expressing the touching position of the reed to the tongue, is transformed to the signals in FIG. 10 by means of the prespecified tables.

Furthermore, the key-code KC expressing the tone pitch of the depressed key is transformed, by a prespecified table, to the signal total len.

What is claimed is:

1. A musical tone synthesizing apparatus comprising:

an operating portion having a mouthpiece and a reed;

breath measuring means for measuring breath passing through the mouthpiece;

tonguing detection means for measuring a relative position of a performer's tongue to the reed;

musical tone signal forming means for synthesizing a musical tone signal, said musical tone forming means including:

an oral cavity simulator, responsive to an output signal from said breath measuring means, for simulating an oral cavity of a performer and generating an excitation control signal indicative thereof;.

a resonance tube excitation signal generator for generating an excitation signal in response to the excitation control signal output by said oral cavity simulator; and a resonance tube simulator, responsive to the excitation signal, for simulating a resonance tube of an acoustic wind instrument and generating a musical tone signal;

said musical tone synthesizing apparatus further including tonguing control means for controlling the characteristics of said excitation signal in response to an output signal from the tonguing detection means.

2. A musical tone synthesizing apparatus comprising:

a keyboard;

a keyboard operation data generating means for generating an operation data of the keyboard;

musical tone forming means for forming a musical tone signal, said musical tone forming means including an oral cavity simulator for simulating an oral cavity and generating an excitation control signal in response to an output signal from the keyboard operation data generating means, a resonance tube excitation signal generator for generating an excitation signal in response to the excitation control signal output by said oral cavity simulator, and a resonance tube simulator, responsive to the excitation signal, for simulating a resonance tube of a wind instrument, and generating a musical tone signal; and control means for controlling a characteristic of said excitation signal in response to a predetermined output signal from the keyboard operation data generating means.

3. A musical tone synthesizing apparatus according to claim 1, wherein the tonguing control means comprises a multiplier for multiplying the excitation signal by a coefficient, the coefficient being set at a constant value when the tongue touches the reed part, and the coefficient being set at another constant value when the tongue parts from the reed part.

4. A musical tone synthesizing apparatus according to claim 1, wherein the musical tone forming means mixes a signal affected by tonguing, with another signal independent of the tonguing, and the tonguing control means controls a mixing ratio of the signal affected by tonguing and the signal independent of the tonguing.

5. A musical tone synthesizing apparatus according to claim 2, wherein the musical tone forming means mixes a signal affected by tonguing, with another signal independent of the tonguing, and the control means controls a mixing ratio of the signal affected by tonguing and the signal independent of the tonguing.

6. A musical tone synthesizing apparatus comprising;

musical tone control signal generating means for generating a musical tone control signal for controlling generation of a musical tone signal in response to a performance operation;

tonguing signal generating means for outputting a tonguing signal in response to a performer's tonguing operation;

first signal loop means including a first delay for receiving said musical tone control signal and outputting an excitation control signal;

second signal loop means including a second delay having a delay amount which depends on at least one characteristic of a musical tone being synthesized;

excitation control means for controlling at least one characteristic of the excitation control signal output from said first signal loop means in response to said tonguing signal and generating an excitation signal for said second signal loop means.

* * * * *